US006045387A

United States Patent [19]

Papini

[11] Patent Number: 6,045,387

[45] Date of Patent: Apr. 4, 2000

[54] SOCKET FOR TWO-PIN LAMPS

[75] Inventor: Oris Papini, Kierspe, Germany

[73] Assignee: Bender & Wirth GmbH & Co., Kierspe, Germany

[21] Appl. No.: 08/984,874

[22] Filed: Dec. 4, 1997

[30] Foreign Application Priority Data

Apr. 11, 1997 [DE] Germany ..... 29706525 U

[51] Int. Cl.[7] ..... H01R 4/50

[52] U.S. Cl. ..... 439/337; 439/241

[58] Field of Search ..... 439/240–242, 439/336, 337, 346, 619, 699.1, 699.2

[56] References Cited

U.S. PATENT DOCUMENTS

| | | | |
|---|---|---|---|
| 3,066,276 | 11/1962 | Hubbell et al. | 439/337 |
| 3,363,217 | 1/1968 | Garver et al. | 439/337 |
| 4,256,989 | 3/1981 | Trutner et al. | 439/337 |
| 4,422,712 | 12/1983 | Koszytorz | 439/242 |
| 5,542,857 | 8/1996 | Hume et al. | 439/337 |

*Primary Examiner*—Khiem Nguyen
*Attorney, Agent, or Firm*—Friedrich Kueffner

[57] ABSTRACT

A socket for two-pin lamps, wherein the socket has a housing defining chambers for receiving contacts for the lamp pins and the housing has insertion openings for the lamp pins, and wherein the ends of the pins have heads which contact the contacts in the chambers in a resilient manner when the pins are inserted in the insertion openings and the pins project into the chambers. The insertion openings extend arc-shaped on the housing, wherein the width of a first portion of each insertion opening is greater than the width of the pin head, while a second portion of each insertion opening has a width which is smaller than the width of the pin head but greater than the width of the pin itself. When the lamp is turned in the insertion openings, the lamp surface supporting the pins is pulled against a support surface of the housing.

5 Claims, 1 Drawing Sheet

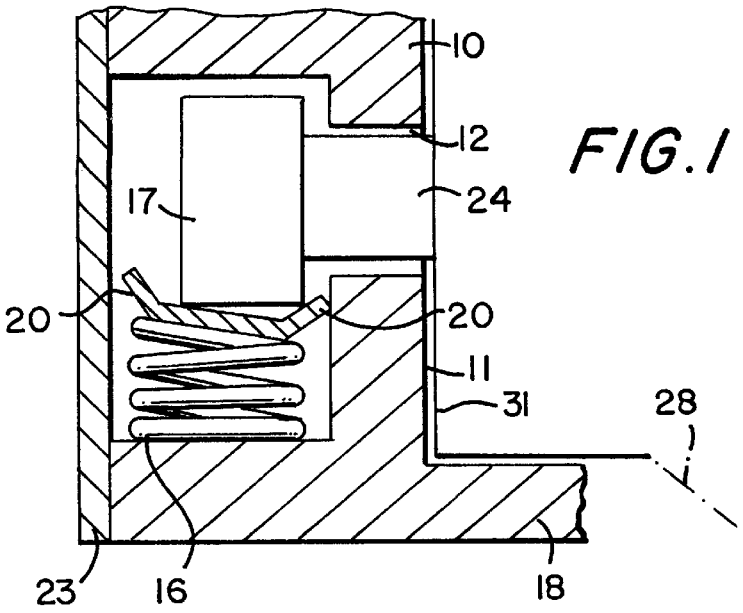
FIG. 1
FIG. 2
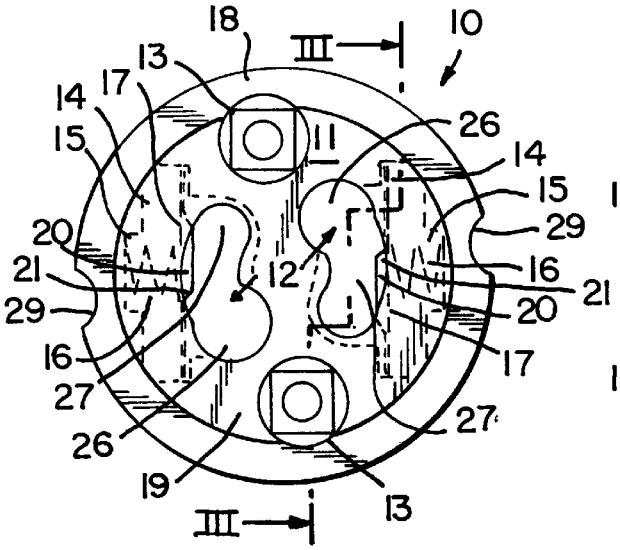
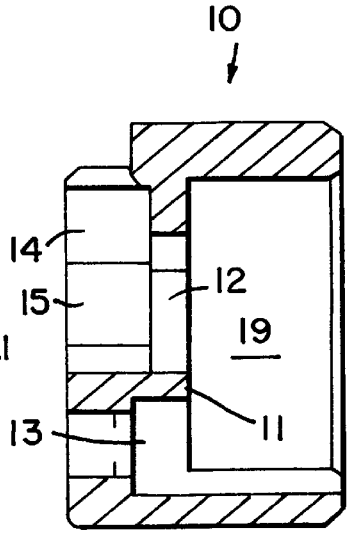
FIG. 3
FIG. 4
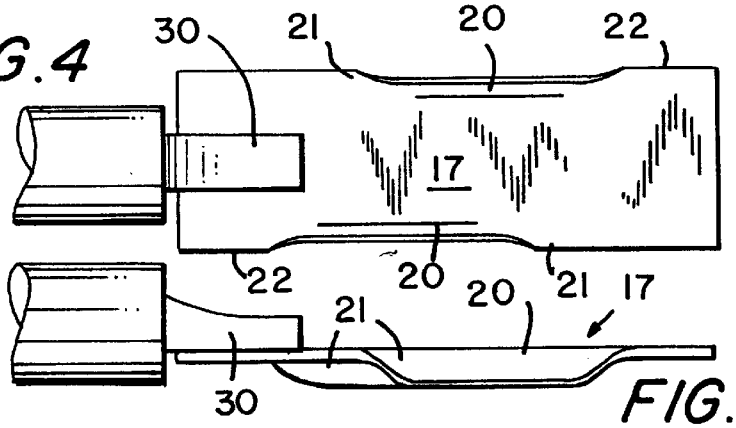
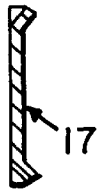
FIG. 5
FIG. 6

SOCKET FOR TWO-PIN LAMPS

BACKGROUND OF THE INVENTION

1. Field of the Invention

The present invention relates to a socket for two-pin lamps, wherein the socket has a housing defining chambers for receiving contacts for the lamp pins. The housing has insertion openings for the lamp pins, wherein the ends of the pins have heads which contact the contacts in the chambers in a resilient manner when the pins are inserted in the insertion openings and the pins project into the chambers. The insertion openings extend arc-shaped on the housing, wherein the width of a first portion of each insertion opening is greater than the width of the pin head, while a second portion of each insertion opening has a width which is smaller than the width of the pin head but greater than the width of the pin itself.

2. Description of the Related Art

Lamps and sockets of the above-described type are used frequently. However, it has been found to be a disadvantage in certain types of applications that the lamp is arranged in the socket with different insertion depths. For example, if such a lamp is used in projectors which have a certain optical light system, the incandescent portion of the lamp is not located exactly at the desired location; rather, depending on the depth of insertion, the incandescent portion is located below or above the center line of the optical system, so that light losses may occur.

SUMMARY OF THE INVENTION

Therefore, it is the primary object of the present invention to provide a socket of the above-described type which is constructed in such a way that the lamp is always arranged with the same depth in the housing of the socket. If possible, the exact relative arrangement is to be achieved automatically. Nevertheless, the manufacture of the socket should be inexpensive.

In accordance with the present invention, when the lamp is turned in the insertion openings, the lamp surface supporting the pins is pulled against a support surface of the housing.

The heads of the pins make it possible to achieve a contact point at the lamp in order to be able to pull the heads together with the lamp deeply into the housing chambers. In addition, it is possible to provide by the rotation of the lamp a type of inclined stop surface at the housing, wherein the inclined stop surface produces a pulling action at the pins which causes the lamp to be pulled toward the support surface for the lamp provided with the insertion openings. After the lamp has been correctly inserted, it is always insured that the lamp is always placed precisely located on the upper surface of the housing on the support surface.

In accordance with a special embodiment of the invention, the resilient contact engages behind the pin head and biases the pin head in the end position thereof into the insertion direction of the pins into the housing. This measure produces the result that the spring action of the contact exerts a pulling action on the lamp, so that the lamp always securely rests on the support surface of the housing.

In accordance with a recommended feature, in the end position of the lamp, the plate-shaped contact rests with an inclined surface against the head of the pin in the area between the head and the pin. In that case, the contact is biased by a compression spring in such a way that the inclined surface exerts a pulling action on the pin head which causes the head to be pulled deeper into the contact chamber.

In accordance with another recommended feature, the inclined surface forming an angle with the plate-shaped contact is provided with an inclined stop surface which guides the head of the pin against the inclined surface when the lamp is turned in the arc-shaped insertion openings. The inclined surface is advantageously provided on one side at a longitudinal edge of the plate-shaped contact.

On the other hand, in a special embodiment, an inclined surface with inclined stop surface is provided at both longitudinal sides of the contact. As seen in a top view of the contact, the inclined surface with inclined stop surface at one longitudinal side is offset relative to the inclined surface with inclined stop surface on the other longitudinal side. This makes it possible to easily mount the contact because the contact can be inserted into the chamber in either direction without resulting in any disadvantage.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

FIG. 1 is partial sectional view showing a lamp pin with pin head received in a housing chamber of the socket according to the present invention.

FIG. 2 is a top view of the socket of FIG. 1;

FIG. 3 is a sectional view of the socket taken along sectional III—III of FIG. 2;

FIG. 4 is a top view of the plate-shaped contact;

FIG. 5 is a transverse sectional view of the plate-shaped contact; and

FIG. 6 is a side view of the plate-shaped contact.

DESCRIPTION OF THE PREFERRED EMBODIMENTS

The socket illustrated in the drawing is composed of an insulation housing 10 constructed as a cylinder portion. The upper side of the housing 10 forms a support surface 11 which is surrounded by an outwardly projecting rim 18 in such a way that a receiving chamber 19 is formed in which the lamp 28 is partially inserted. The lamp 28 is inserted to such an extent that the support surface 11 of the socket comes into contact with the lamp surface 31 of the lamp 28.

Contact chambers 14 are provided in the interior of the insulation housing 10. A compression spring 16 is provided in each contact chamber 14 on a support surface 15. The compression spring 16 rests against the contact 17 to such an extent that the contact 17 extends up to the insertion openings 12. The insulation housing 10 is additionally provided with fastening openings 13 by means of which the insulation housing is secured to a carrier. The contact 17 is plate-shaped. The contact 17 has at two oppositely located longitudinal sides 22 an inclined surface 20 each, wherein each inclined surface 20 is provided with an inclined stop face 21.

A closing plate is provided at the bottom side of the insulation housing, wherein the closing plate closes the contact chambers 14 and, thus, supports the contacts 17 located in the interior of the housing. The current supply to the lamp 28 is effected through the contacts 17 to which a supply line 30 each is connected. Fastening can be effected by welding, soldering or crimping, as indicated in FIGS. 4 and 6.

Each insertion opening 12 has an insertion portion 26 and a turning portion 27. The current connectors of a two-pin halogen lamp, i.e., the pins 24 which have at their free ends a cylindrical head 25, are inserted through the insertion openings.

The insertion portion 26 of each insertion opening is dimensioned with such a size that the head of the respective lamp pin can be easily pushed into the contact chamber. On the other hand, the turning portion 27 is so small that only the diameter of the pin itself can be accommodated. In this manner, it is ensured that the head engages behind the turning portion and the lamp cannot drop away from the housing because the pin head always engages behind the turning portion 27.

As can be seen in FIG. 1, the pin head is arranged in the chamber while the pin itself is located in the turning portion 27. The head contacts a contact 17, particularly an inclined surface 20 of the contact at that side of the contact where the pin 24 is provided at the head 25, while the actual plate portion of the contact is capable of contacting the free end of the head. This position is reached by turning the lamp and, thus, the two pins 24 with the heads 25 in the insertion openings 12. When the lamp is turned, the two heads 25 of the pins first contact an inclined stop face 21 and, in the final end position, the heads 25 contact the inclined surface 20. The inclined surface 20 now exerts through the compression spring 16 such a pressure on the head of the pin of the two-pin lamp that the pin is moved more deeply into the chamber 14 and the lamp 28, shown partially in dash-dot lines with its surface 31, is pulled against the support surface 11. This support surface 11 constitutes a reference surface for the light cone which later emanates from the lamp, so that the precise height of the insulation housing can be adjusted relative to an optical system or another component where this precise alignment is of importance. Finally, it should be briefly mentioned that semicircular recesses 29 are provided at the outer rim of the housing which have the purpose of precisely securing the insulation housing at a carrier.

The embodiment of the present invention illustrated in the drawing can be modified in various ways an can be used differently. It is not necessary that the head of each pin is cylindrical. Rather, it could also be constructed mushroom-shaped. It is only important that an area is created where the contact of the compression spring can engage. In addition, it should be mentioned that the contact or current supply can also be effected through the compression spring which could be connected, for example, to an electric supply line. Also, it would be possible instead of contact and pressure spring to use a type of plate spring and to fixedly attach one end of the plate spring in the chamber, while the other end or the longitudinal sides thereof would be provided with the inclined surfaces. It would only have to be ensured in this case that the plate spring has such a force that it is capable of pulling the lamp against the support surface of the housing.

While specific embodiments of the invention have been shown and described in detail to illustrate the inventive principles, it will be understood that the invention may be embodied otherwise without departing from such principles.

I claim:

1. A socket for a two-pin lamp, the socket comprising a housing defining chambers for receiving resilient contacts for lamp pins, the lamp pins having ends, the housing having insertion openings for the lamp pins, wherein the ends of the pins have heads for engaging in resilient contact with the resilient contacts in the chambers when the pins are inserted in the insertion openings and project into the chambers, the insertion openings extending arc-shaped on the housing, wherein a first portion of each insertion opening has a width which is greater than a width of the pin head, and a second portion of each insertion opening has a width which is smaller than the width of the pin head but greater than a width of the pin, the housing having a support surface, the lamp having a lamp surface supporting the pins, wherein each resilient contact is configured such that, with a pin head being inserted head-first in the housing, said resilient contact engages the pin head from behind with the effect that, as the lamp is turned in the insertion openings, a surface of the lamp is pulled against the support surface of the housing.

2. The socket according to claim 1, wherein each resilient contact is configured to bias a pin head into an end position, the biasing taking place in a direction corresponding to the direction of insertion of the pin into the housing.

3. The socket according to claim 2, wherein each contact is plate-shaped having an inclined surface on a longitudinal side thereof, the plate-shaped contact resting in the end position with the inclined surface against the pin head in an area between the head and the pin, further comprising a compression spring for biasing the contact such that the inclined surface exerts a pulling action on the pin head, whereby the head is caused to be pulled deeper into the contact chamber.

4. The socket according to claim 3, wherein the inclined surface of each plate-shaped contact defines an angle with the contact and has an inclined stop surface for guiding the head of the pin against the inclined surface when the lamp is turned in the arc-shaped insertion opening.

5. The socket according to claim 4, wherein the plate-shaped contact has inclined surfaces with inclined stop surfaces on both longitudinal sides thereof, wherein one of the inclined surfaces with inclined stop surface at one longitudinal side is offset in longitudinal direction relative to another of the inclined surfaces with inclined stop surface on another of the longitudinal sides.

* * * * *